US005758982A

United States Patent [19]

Yoshida et al.

[11] Patent Number: 5,758,982

[45] Date of Patent: Jun. 2, 1998

[54] ROLL PAPER TERMINAL END DETECTING UNIT AND METHOD

[75] Inventors: Naoki Yoshida; Toshiharu Tamura, both of Tokyo, Japan

[73] Assignee: Altech Company Limited, Tokyo, Japan

[21] Appl. No.: 540,188

[22] Filed: Oct. 6, 1995

[30] Foreign Application Priority Data

Nov. 1, 1994 [JP] Japan ..... 6-268802

[51] Int. Cl.[6] ..... B41J 29/46

[52] U.S. Cl. ..... 400/708; 400/703; 242/563

[58] Field of Search ..... 400/708, 703, 400/610.4, 610.3, 711, 249, 219, 219.2, 219.3, 219.4; 73/156, 159, 160; 242/563, 912, 534

[56] References Cited

U.S. PATENT DOCUMENTS

| | | | |
|---|---|---|---|
| 3,635,417 | 1/1972 | Kajiwara et al. | 242/563 |
| 4,019,618 | 4/1977 | Busch | 400/219.3 |
| 4,893,763 | 1/1990 | Wales et al. | 242/534 |
| 5,197,688 | 3/1993 | Giorgio et al. | 242/563 |

FOREIGN PATENT DOCUMENTS

| | | | |
|---|---|---|---|
| 395023 | 10/1990 | European Pat. Off. | 242/563 |
| 58-102791 | 6/1983 | Japan | 400/708 |
| 2137969 | 5/1990 | Japan | 400/708 |

OTHER PUBLICATIONS

Beistle, "Arrangement ofr Detectin A Web or Tape Wrapped on A Hub", IBM Technical Disclosure Bulletin, vol. 23, No. 4 Sep. 1980.

*Primary Examiner*—Edgar S. Burr
*Assistant Examiner*—Anthony H. Nguyen
*Attorney, Agent, or Firm*—McGlew and Tuttle

[57] ABSTRACT

A recording/printing unit using roll paper, and method for easily and securely detecting the terminal end of roll paper rolled around a core inside a color printer. The outside face of said core is darker than the roll paper. A sensor is provided for detecting the intensity of reflected light. A pinch roller is provided turning in contact with the roll paper surface and a spring is provided for pressing the pinch roller against the surface of roll paper, and for detecting the terminal end of roll paper by the change in the intensity of reflected light.

8 Claims, 2 Drawing Sheets

ROLL PAPER TERMINAL END DETECTING UNIT AND METHOD

FIELD OF THE INVENTION

The present invention relates to a roll paper terminal end detecting unit and a method in the recording/printing unit for recording the letters, figures, tables and pictures on roll paper rolled around a drum and more particularly to color printer using a sublimation ribbon for color and being equipped with a thermal head.

BACKGROUND OF THE INVENTION

Printers are known and available that selectively provide the impact force to the transcription material by a solid ball or a print wire, to form an ink jet by heat, vibration, electric field and magnetic field, to selectively provide the heat to the transcription material using a thermal head and selectively transfer the heat to the heat sensitive recording paper using a thermal head.

In recent years, there has arisen a great need for the realization of color. The professional use of a universal type printer as well as business use printer is expanding especially in the field of CAD and computer graphics.

Further, because a variety of conventional printers use cut paper in many situations, the transfer route of paper inside the unit essentially becomes complex, and as a result, the enlargement of recording paper and the maintenance of the printer unit becomes difficult. These matters are important especially in case of the color printer. In the color printer printing 3 colors and black 4 times, the complex paper transfer routes makes it difficult to enhance the positioning accuracy, and the color picture quality was insufficient. This resulted in a vicious cycle requiring the more complex mechanism for enhancing the positioning and picture quality.

Therefore, there is a method for using roll paper instead of the cut paper as the recording paper, and for example, it was thought to roll the recording paper around the periphery of a large size drum and to print on the same face 4 times by turning the drum 4 times. Further, there is such a method as installing a plurality of roller units before and after the platen roller and pulling and feeding the recording paper several times in positive and reverse main run directions after pulling the roll paper out of the drum.

Further, the present inventors have already invented a recording/printing unit consisting of a platen roller shown in FIG. 1, a roll type recording paper being fed out on the said platen roller. A recording/printing head is provided. The recording/printing paper pull-feeding mechanism is installed which consists of the clamp opening/closing unit for catching the end of said roll type recording/printing paper and making the linear reciprocation movement by the designated cycles at every recording/printing in accordance with the length in the main run direction being recorded at one time. Also a roll paper drum is provided where the roll type recording/printing paper can be turned in a reverse direction for pulling back the recording/printing paper when it reciprocates at the designated cycles.

In the recording/printing unit such as the printer using roll paper, attention must be paid to the replacement of roll paper when it has been consumed. The merits of such an arrangement can be achieved if the setting of roll paper and the maintenance of the paper are easy.

SUMMARY AND OBJECTS OF THE INVENTION

An object of this invention is to provide a unit and method for easily and securely detecting the terminal end of roll paper rolled around the core in the recording/printing unit (printer) using roll paper, especially in a color printer.

As a result of ardent study, the inventors have found out that the above noted problems can be solved by detecting with a sensor the color change of the core on which the roll type recording/printing paper is rolled. With this the inventors have reached the features of the invention.

According to the invention, a recorder/printer unit is provided which preferably includes:

(1) A roll paper terminal end detecting unit for detecting the terminal end of roll paper rolled around the core, the roll paper type recording/printing unit, comprising a photo sensor for detecting the intensity of reflected light where the outside face of the core is darker than the roll paper, the pinch roller turning in contact with the roller paper surface and keeping the distance between the photo sensor and the measured surface to a constant following the reduction in roll diameter and the spring for pressing the said pinch roller against the surface of roll paper, which is characterized by detecting the terminal end of roll paper by the change of intensity of reflected light.

(2) A roll paper terminal end detecting unit which is characterized in that the roll paper type recording/printing unit is a sublimation type color printer.

(3) Roll paper terminal end detecting unit where the roll paper type recording/printing unit consists of a platen roller, a roll type recording/printing paper being pulled and fed on the platen roller and a recording/printing unit, which is characterized in that the recording/printing paper pulling and feeding mechanism comprises the clamp opening/closing unit for catching the end of roll type recording/printing paper and making the linear reciprocation movement by the designated cycles at every recording/printing in accordance with the length of main run direction being recorded at one time and also a roller paper drum that can be turned in reverse direction for pulling back the recording/printing paper when the said roller type recording/printing paper reciprocates at the designated cycles.

(4) Roll paper terminal end detecting unit, in the method for detecting the terminal end of roll paper rolled around the core in the roll paper type recording/printing unit, which is characterized by making the outer face of said core darker than the roll paper, pressing with a spring the pinch roller to the surface of turning roll paper and detecting the terminal end of roll paper by the change of intensity of reflected light detected by the photo sensor.

(5) Roll paper terminal end detecting unit is characterized in that the roll paper type recording/printing unit is a sublimation type color printer.

In the roll paper type recording/printing unit, the roll paper rolled around the core is fed out to the head section sequentially and continuously from its tip and the letters, figures, tables and pictures are recorded on the roll paper. Because the roll paper is a consumable good, the used paper portion rolled around the core is lessened as it is used. The outside diameter of roll paper is continuously decreased, and when the roll paper has entirely been consumed, it becomes the same diameter as that of core such as a roller.

In the device of this invention, the outside surface of core for rolling the roll paper is made darker in color than the roll paper. The roll paper is usually white, but if the paper should be colored because of the convenience of recording/printing system to be used, there is no problem if the core is darker.

The outside surface of core may be colored in touch with the coating material or film, but needs not be especially colored if it has a darker color than the roll paper due to the material of core.

The roll paper terminal end detection of this invention is made by evaluating the intensity of light being reflected from the roll paper and core by use of the photo sensor. Namely, the consumption of roll paper is judged by detecting the change from the strong reflected light from the white or thin color roll paper to the weak reflected light from the dark color, for example, black or brown color of the outside surface of the core. The result which has been detected in this way is notified to the user by means of the desired means of display light, buzzer sound, liquid crystal display, etc. Usually the roll paper is white whereas the core is black, brown and dark brown so that the difference of shade becomes great, which is preferable because the detection of intensity of reflected light becomes easier.

The roll paper terminal end detecting unit of this invention is structured of a pinch roller being pressed against the roll paper, following its rotation, and keeping the distance between the photo sensor and the measured face to a constant in pursuit of the reduction of roll diameter, a photo sensor arranged in the vicinity of this pinch roller being the sensor portion, and a bearing body and a spring for supporting the rotation of photo sensor portion and pressing it to the roll paper surface whose outside diameter is decreasing. In addition to the said basic structure, the light source such as the lamp, light emitting diode (LED), semi-conductor laser and the other light emitting element for illuminating the light to the roller paper surface is arranged in the vicinity of photo sensor. These light emitting sources may be the mono-block type reflection light sensor in combination with the light receiving element such as a photo diode.

The roll paper terminal end detecting unit of this invention is applied to various roll paper type recording/printing units which are conventionally known. For example, a variety of printers and instrumentation equipment can be enumerated, but this unit according to the invention is best suited for the printers whose advance is especially conspicuous in recent years, above all to a large type process color printer being used for CAD and CG applications.

As an example of color printer, especially preferable is the recording/printing unit consisting of a platen roller invented by the inventors, a roll type recording/printing paper being pulled and fed on the said platen roller and a recording/printing paper, wherein the recording/printing paper pull/feed mechanism is installed which is structured of a clamp opening/closing unit for catching the end of said roll type recording/printing paper and making the linear reciprocation movement by the designated cycles per every recording/printing in accordance with the length of main run direction being recorded at one time, and a roll paper drum that can be turned in reverse direction for pulling back the recording/printing paper when the said roll type recording/printing paper reciprocates at the designated cycles.

The roll paper terminal end detecting unit and method of this invention are applied to the recording/printing unit for printing letters on the roll type recording/printing paper using a head. For example, as the recording/printing using the heat as the recording/printing energy. This relates to the heat sensitive recording/printing for making the heat head contact with the recording/printing paper for its coloring by heating it, and the heat transcription recording/printing for transcribing the ink on transcription film to the recording/printing paper by heating it, and moreover, the heat transcription recording/printing which can be classified into the fusion type heat transcription using the fusion type ink sheet which is fused by heat application and the sublimation type heat transcription using the sublimation type ink sheet wherein the sublimation dye sublimates by the heat application from a rear face of dye layer and is diffused and melts (it is molten) into the receiving layer of recording/printing paper for its coloring. As the recording/printing using the pressure as the recording/printing energy, there are the pressure sensitive recording/printing for coloring in chemical change by pressurization, and the ink jet system for controlling the release and jet of ink drips with pressure for adhering it to the recording/printing paper. Various systems have been developed in this ink jet system, but among them, it can be largely classified into the on-demand type and the continuous type, and the on-demand type covers the electric/mechanical change-over system, electric/heat change-over system and electrostatic suction system. Among them, the bubble jet system and thermal ink jet system using the thermal head are suitable for this invention. Besides the aforementioned, there are the electric heat sensitive recording/printing and electrostatic recording/printing using the electric current and the recording/printing using the light and magnet as the recording/printing energy, and a variety of recording/printing systems can be applied to this invention.

Out of these recording/printing units and recording/printing methods, those using the thermal head especially as the head are suitable for the recording/printing unit of this invention in respect of the controllability, resolution and gradient, and the heat sensitive recording/printing, fusion type thermal transcription, sublimation type thermal transcription and bubble jet are preferable. Out of them, especially the sublimation type thermal transcription has such advantages that it is high in gradient and has a high reproducibility of picture density, its gradation in low density area is smooth, high density can be obtained, and in addition to the picture quality problem that it has a high resolution, the unit is comparatively compact and can be made lower in price, the maintenance is easy, the output time is short and a higher speed can be attained, and these features are especially effective to the color printer or one of the recording/printing units to which this invention is applied.

The roll type recording/printing paper used in this invention is rolled around the core of reel or drum in the continuous state instead of the sheet which is used for each of said recording/printing system. For example, in case of the sublimation type thermal transcription, the picture receiving paper is used where the receiving layer, which is designed to absorb the dye, is provided on the smooth basic material and the parting layer for preventing the thermal fusion with the transcription film is provided on the receiving layer surface.

The roll type recording/printing paper is recorded by each of said recording/printing systems when it passes through between the printing head and the platen roller. For example, in the sublimation type thermal transcription, in addition to the said picture receiving paper, an ink ribbon is used where the dye layer containing the sublimation type dye is provided on one side of base film of polyester thin film and the like and the transcription film provided with a heat resistant smooth layer is rolled up on the rear face. The transcription film is overlapped with the picture receiving paper, and when it is passed between the thermal head and the platen roller, the sublimation dye sublimates and is fused in dispersion into the receiving layer for its coloring by heating the dye layer instantaneously from its rear face at a high temperature. The full color picture can be obtained by outputting and overlapping in one color each the transcription films of yellow, magenta, cyan and black in sequence using the thermal head. For information, if the black is not used in the color, this invention can be applied to the roll paper type.

In the recording/printing system using the ink ribbon such as the sublimation type thermal transcription, a single color ribbon in case of a single color and a multi color ribbon in case of multi colors being used, and in case of the multi color ribbon, there are the stripe coating system and the uneven coating system, but recently, the face sequential system for recording/printing each picture in line system, for example having the dye layers of yellow, magenta, cyan and black in face sequence is being used. For information, the order of these dye layers differs in some cases.

The function and construction of the printing head can be changed widely by adopting any of said recording/printing systems. Namely, the function and construction of bead change depending on the kind of recording/printing system energy. For example, various printers depending on the electric, pressure, heat, light and magnetic energies have already been known, and these constructions are adopted also in this invention. Out of them, the thermal head is excellent not only in such functional aspects as printing density, high speed, low noise and controllability but also in such structural aspects as unit realization and compact size realization, and best suits for the roll paper type recording/printing unit.

In addition to the roll paper terminal end detecting unit of this invention, a variety of sensors for detecting the position of recording/printing paper, ink ribbon, clamp opening/closing unit and the end of paper, head driving circuit and memory, cooling fan, inputting/outputting connectors, overcurrent breakers, motors for driving various parts, switches for maintenance, etc. can be installed as necessary to the recording/printing unit being used in this invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
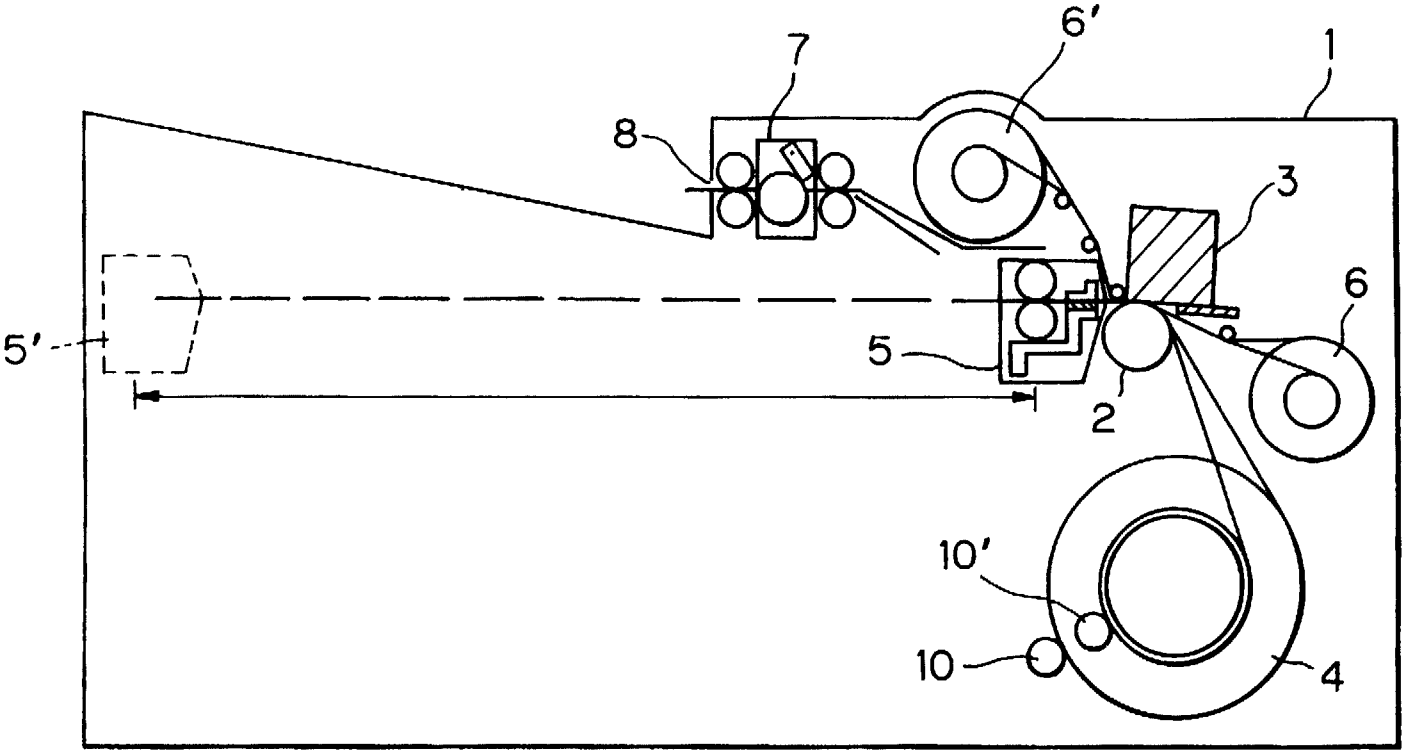
FIG. 1 is a sectional view showing one example of sublimation type heat transcription color printer.

Referring to the drawings and in particular to FIG. 1, the invention comprises roll paper terminal end detecting unit and method with roll type recording/printing paper 4 rolled around the drum and the sublimation type ink ribbon 6 having the dye layers in the face sequence of yellow, magenta, cyan and black. The paper is pulled and fed between the platen roller 2 and the thermal head 3 inside the recording/printing unit 1. The tip of roll type recording/printing paper is clamped by the clamp opening/closing unit 5. The clamp opening/closing unit 5 linearly reciprocates between the initial position shown by 5 and the pull-out position shown by 5' with the length shown by arrow mark in the figure as the maximum. Its drive source is not shown in the figure, but the linear reciprocation movement of high accuracy can be obtained by installing the gears to the outside of the clamp opening/closing unit 5, fitting a timing belt to it, and turning the timing belt with a pulse motor.

A cutter unit 7 is installed between the clamp opening/closing unit 5 and the paper discharging port 8, and the paper cut to the designated size is discharged from the paper discharging port. The ink ribbon is fed in the face sequence of yellow, magenta, cyan and black by two drums 6 and 6'.

Because of the mechanism, as the print operation advances, the roll state recording/printing paper changes its outside diameter and becomes smaller. Both the maximum outside diameter state, namely the roll paper is rolled up in maximum and the minimum outside diameter state, namely the roll paper is consumed are shown in double in FIG. 1. In FIG. 1, numeral 10 and 10' are the pinch rollers being pressed to the roll paper and following its rotation. The pinch roller 10 when the outside diameter of roll paper is maximum moves always following the change of outside diameter of roll paper down to the pinch roller 10' when the outside diameter is minimum.

Figure 2:
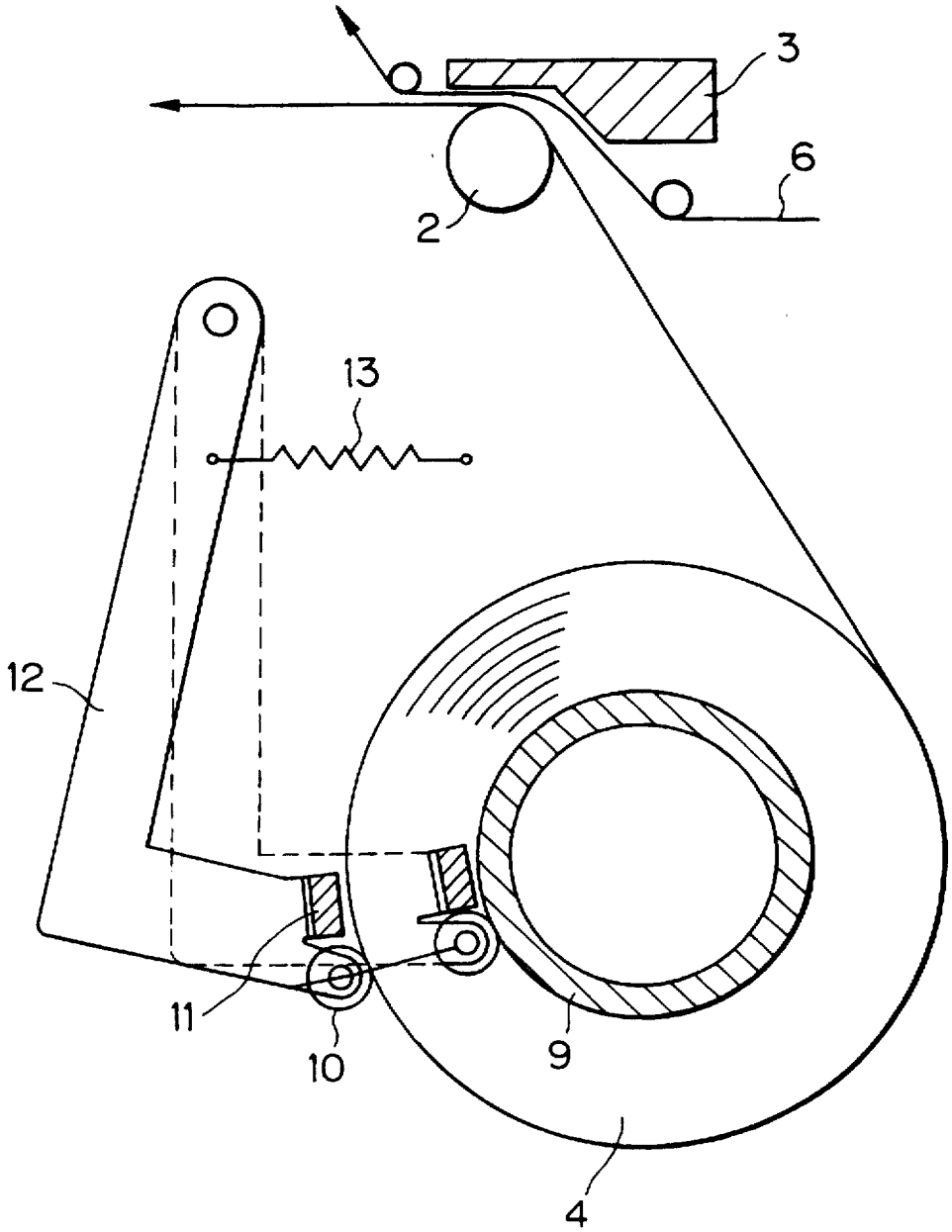
FIG. 2 is a detailed sectional view in the vicinity of roll paper

FIG. 2 is a detailed sectional view in the vicinity of roll paper 4 and pinch roller 10. The roll paper rolled around the core 9 is printed by the thermal head 3 via the ink ribbon 6 when it is fed through the platen roller 2. The pinch roller 10 following the turning of roll paper gets in touch with the surface of roll paper. The pinch roller 10 is always pressed against the surface of roll paper by the bearer 12 and the spring 13 pulling the bearer toward the roll paper. A photo sensor 11 is installed on the bearer 12 in the vicinity of the pinch roller 10 or the pinch roller 10 is fixed, and the light from the light source not shown in the figure is reflected by the roll paper surface and its intensity is detected by the light receiving element. The photo sensor 11 and the pinch roller 10 approach the core 9 when the paper is decreased following the reduction in the outside diameter of the roll paper. When the roll paper reaches its terminal end and the outside face of the core appears, the photo sensor 11 judges the intensity of reflected light because of the dark color of core 9, and indicates that the roll paper has been consumed.

As described above, the roll paper terminal end detecting unit and method of this invention is mechanically simple. For this reason, such excellent effects can be exhibited that the unit can be designed to be compact in size, the arrangement inside the recording/printing unit is easy, and moreover the trouble is less, rarely requiring maintenance. This invention can be effectively applied to color printer using a color sublimation type ribbon and a thermal head.

While specific embodiments of the invention have been shown and described in detail to illustrate the application of the principles of the invention, it will be understood that the invention may be embodied otherwise without departing from such principles.

What is claimed is:

1. A roll paper terminal end detecting unit for detecting the terminal end of roll paper in a roll paper type recording/printing unit, the detecting unit comprising:

a core for supporting the paper roll, said core having a paper roll supporting surface which is darker than the roll paper, one of an outer roll surface of said roll paper and said paper roll supporting core surface forming a measured surface;

a photo sensor with an element for emitting light and for detecting the intensity of reflected light, said photo sensor detecting a change in the intensity of reflected light between the terminal end of the roll paper and said paper roll supporting core, surface;

a photo sensor bearer support, said photo sensor being connected to and supported on said bearer support to direct said photo sensor toward said measured surface;

a pinch roller in contact with said measured surface for maintaining a distance between the photo sensor and said measured surface so the photo sensor follows the reduction in roll diameter of the roll paper, said pinch roller being connected to and supported by said bearer support and being disposed adjacent to said photo sensor; and a spring for pressing said bearer support to press said pinch roller against the surface of the roll paper, whereby said photo sensor detects the terminal end of the roll paper through the change in the intensity of reflected light.

2. A roll paper terminal end detecting unit according to claim 1, in combination with the roll paper type recording/printing unit, wherein the roll paper type recording/printing unit is a sublimation type color printer.

3. A roll paper terminal end detecting unit according to claim 1, in combination with the roll paper type recording/printing unit, wherein the roll paper type recording/printing includes a platen roller, a roll type recording/printing paper pull-feed mechanism for pulling the paper on said platen roller and a recording/printing head, and wherein the recording/printing paper pull feeding mechanism includes a clamp unit for catching the end of said roll type recording/printing paper and making a linear reciprocation movement for a predetermined number of cycles at every recording/printing in accordance with a length in a main run direction which is recorded at each cycle, and a roll paper drum turnable in reverse and having means for pulling back the recording/printing paper when said roll type recording/printing paper reciprocates during said predetermined cycles.

4. A method for detecting the terminal end of roll paper rolled around the core in the roll paper type recording/printing unit to provide a roll paper terminal end detecting unit, the method comprising the steps of:

providing a roll paper core supporting roll paper with a roll paper supporting surface made darker than the roll paper, one of an outer roll surface of said roll paper and said paper roll supporting surface forming a measured surface;

providing a photo sensor with an element for emitting light and for detecting an intensity of reflected light;

providing a photo sensor bearer support, said photo sensor being connected to and supported on said bearer support to direct said photo sensor toward said measured surface;

maintaining a distance between the photo sensor and said measured surface so the photo sensor follows the reduction in roll diameter of the roll paper based on said distance by providing a pinch roller in contact with said measured surface, said pinch roller being connected to and supported by said bearer support and being disposed adjacent to said photo sensor;

pressing said bearer support with a spring to press said pinch roller, by spring force, on to the surface of turning roll paper; and detecting the terminal end of roll paper by detecting a change in the intensity of reflected light which is detected by the photo sensor, between said outer roll surface of said roll paper and said roll paper supporting surface.

5. The method according to claim 4, in combination with the roll paper type recording/printing unit, wherein the roll paper type recording/printing unit is a sublimation type color printer.

6. A roll paper terminal end detecting unit for detecting the terminal end of roll paper in a roll paper type recording/printing unit, the detecting unit comprising:

a core for supporting the paper roll, the outside surface of said core being darker than the roll paper, one of an outer roll surface of said roll paper and said paper roll supporting core surface forming a measured surface;

a bearer support;

a pinch roller connected to and supported by said bearer support, said pinch roller engaging the surface of the paper roll to follow the surface of the paper roll during a feeding out of paper to follow a reduction in roll diameter of the roll paper;

a spring for pressing said bearer support to press said pinch roller against the surface of the roll paper; and photo sensor means for detecting an intensity of reflected light for detecting the terminal end of the roll paper through the change in the intensity of reflected light between said outer roll surface of said roll paper and said outside surface of said core, said photo sensor being connected to and supported on said bearer support to direct said photosensor toward said measured surface, said photo sensor being maintained a spaced distance from said measured surface by said pinch roller.

7. A roll paper terminal end detecting unit according to claim 6, in combination with the roll paper type recording/printing unit, wherein the roll paper type recording/printing unit is a sublimation type color printer.

8. A roll paper terminal end detecting unit according to claim 6, in combination with the roll paper type recording/printing unit, wherein the roll paper type recording/printing includes:

a platen roller;

a roll type recording/printing paper pull-feed mechanism for pulling the paper on the said platen roller and a recording/printing head, and wherein the recording/printing paper pull feeding mechanism include a clamp opening/closing unit for catching the end of said roll type recording/printing paper and making a linear reciprocation movement for a predetermined number of cycles at every recording/printing in accordance with a length in a main run direction which is recorded at each cycle, and a roll paper drum turnable in reverse and having means for pulling back the recording/printing paper when said roll type recording/printing paper reciprocates during said predetermined cycles.

* * * * *